US010259247B2

(12) United States Patent
Dietemann

(10) Patent No.: US 10,259,247 B2
(45) Date of Patent: Apr. 16, 2019

(54) SECURITY SHEET INCLUDING AN IRIDESCENT SECURITY MARK

(75) Inventor: Philippe Dietemann, Saint-Martin-d'Heres (FR)

(73) Assignee: ARJOWIGGINS SECURITY, Paris (FR)

( * ) Notice: Subject to any disclaimer, the term of this patent is extended or adjusted under 35 U.S.C. 154(b) by 2007 days.

(21) Appl. No.: 12/682,816

(22) PCT Filed: Oct. 21, 2008

(86) PCT No.: PCT/FR2008/051901
§ 371 (c)(1),
(2), (4) Date: May 13, 2010

(87) PCT Pub. No.: WO2009/056730
PCT Pub. Date: May 7, 2009

(65) Prior Publication Data

US 2010/0219626 A1 Sep. 2, 2010

(30) Foreign Application Priority Data

Oct. 22, 2007 (FR) ..... 07 58473

(51) Int. Cl.
*B41M 3/14* (2006.01)
*D21H 21/40* (2006.01)
*D21H 19/36* (2006.01)
*D21H 21/28* (2006.01)

(52) U.S. Cl.
CPC ..... *B41M 3/144* (2013.01); *D21H 21/40* (2013.01); *D21H 19/36* (2013.01); *D21H 21/28* (2013.01)

(58) Field of Classification Search
USPC ..... 283/67, 70, 72, 74, 94, 98, 114, 901
See application file for complete search history.

(56) References Cited

U.S. PATENT DOCUMENTS 4,307,899 A * 12/1981 Hoppe ..... B41M 3/14 283/110
6,369,919 B1 * 4/2002 Drinkwater ..... G03H 1/265 283/86
8,147,932 B2 * 4/2012 Despland et al. ..... 283/91
(Continued)

FOREIGN PATENT DOCUMENTS

EP 0 490 825 A1 6/1992
EP 1 489 151 A1 12/2004
(Continued)

OTHER PUBLICATIONS

International Search Report issued in corresponding International Application No. PCT/FR2008/051901, dated May 25, 2009. (with English-language translation).
(Continued)

*Primary Examiner* — Justin V Lewis
(74) *Attorney, Agent, or Firm* — Oliff PLC

(57) ABSTRACT

A security sheet including an iridescent security mark observable on the surface of the sheet, the mark having at least one zone presenting an iridescent effect, the zone being colored in normal observation with the naked eye and including iridescent pigments that are practically colorless in normal observation and that present an iridescent effect visible only in oblique observation.

10 Claims, 2 Drawing Sheets

(56) References Cited

U.S. PATENT DOCUMENTS

| | | | | |
|---|---|---|---|---|
| 2003/0089251 | A1* | 5/2003 | Brown | B41M 1/12 101/129 |
| 2004/0061325 | A1* | 4/2004 | Lyen et al. | 283/72 |
| 2007/0080533 | A1* | 4/2007 | Bleikholm | B42D 25/29 283/72 |
| 2008/0164690 | A1* | 7/2008 | Heierli | G03H 1/0011 283/87 |
| 2009/0230670 | A1* | 9/2009 | Schmid | B42D 25/29 283/85 |

FOREIGN PATENT DOCUMENTS

| | | |
|---|---|---|
| FR | 2 429 292 | 1/1980 |
| FR | 2 782 470 | 2/2000 |
| FR | 2 855 640 | 12/2004 |
| GB | 2 307 487 A | 5/1997 |
| WO | WO 95/092786 | 4/1995 |

OTHER PUBLICATIONS

International Preliminary Report on Patentability issued in corresponding International Application No. PCT/FR2008/051901, dated Apr. 27, 2010. (with English-language translation).

Nov. 10, 2015 Office Action issued in Canadian Application No. 2,703,057.

* cited by examiner

SECURITY SHEET INCLUDING AN IRIDESCENT SECURITY MARK

The invention relates to a security sheet including a colored security mark that presents an iridescent effect, and it also relates to a document comprising said sheet.

In order to protect against counterfeiting or falsifying security documents such as payment means such as bank notes, checks, or official documents, in particular identity documents such as passports, identity cards, or tickets for entry to cultural or sports events, or transport tickets, or indeed packaging or labeling including an authentication element, it is possible to use various security means such as, for example: security threads, holograms, watermarks, or indeed iridescent pigments that make it possible to authenticate a document by an interference effect that gives rise to a color change that is observable at certain angles. Furthermore, such pigments provide protection against photocopying since the iridescent effect is not copyable.

In particular, European patent application EP-A-0 490 825 describes a security paper including a surface application containing iridescent pigments that are practically not visible in direct observation (i.e. when facing the plane of the application surface on the paper), which application manifests its coloring effect only when it is observed at an oblique angle and changes its coloring when the observation angle is modified, said paper being characterized in that various surface zones that can be perceived simultaneously are provided with applications that contain different iridescent pigments and that present different coloring in oblique observation. The zones are preferably contiguous strips. Such an effect makes it possible for an observer not to see the iridescent strips in direct observation but to see them only in oblique observation, with the fact that the strips can be perceived simultaneously serving to produce better relative perception of the color changes of each of the strips in oblique observation. Nevertheless, the fact that those strips are not visible in direct observation means that an uninformed observer, such as the "man in the street", seeking to authenticate a document does not know where to find the strips on observing the document normally and/or forgets to carry out the verification.

In French patent application FR-A1-2 855 640, a security pattern is described that is made up of a first pattern with interference effect substances and another pattern with substances that react to certain kinds of stimulation to give a light response visible to the human eye, in particular fluorescent substances (responding to ultraviolet (UV) rays). That security means requires a device in order to stimulate the second pattern and make it visible.

Application FR 2 782 470 describes an iridescent ink deposited on a film that is applied to a medium and that is colored when observed by direct reflection.

Application EP 1 489 151 describes a security ink including an iridescent pigment presenting two different colors when observed in reflection.

The object of the present invention is to solve the problems of the prior art and thus to provide a security sheet with authentication means that are easily observable by the man in the street, while presenting a level of security that is sufficient.

The present invention provides security means that are visible both in normal observation (face view) with effects that are visible only under one or more other angles of observation (obliquely) and with the naked eye.

The present invention thus presents the advantage that the man in the street knows where to observe said means, and moreover the fact that certain effects are visible only at certain angles imparts a sufficiently high level of security.

More precisely, the invention provides a security sheet including an iridescent security mark observable on the surface (of the sheet), which sheet is characterized by the fact that said mark includes at least one zone presenting an iridescent effect, said zone being colored in normal observation with the naked eye and including iridescent pigments that are practically colorless in normal observation and that present an iridescent effect that is visible only in oblique observation.

The term "normal observation" means that an observer is looking at the mark or the zone facing the plane respectively of the mark or the zone at an angle of about 90 degrees relative to the plane respectively of said mark or of the zone, and in white light (artificial or natural). This observation may also be said to be direct observation.

The term "observable to the naked eye" means that no appliance is necessary for stimulating coloring, it being understood that magnifying means, such as a magnifying glass, might need to be used in order to be able to see the zone, for example if the zone is made up of micro-characters.

In the present invention, the iridescent effect of the at least said zone is thus practically invisible in normal observation (face view) and is visible only in oblique observation, i.e. only at angles other than at 90 degrees, and moreover the iridescent pigments of said zone do not appear intrinsically colored under normal observation, since they are intrinsically practically imperceptible in normal observation. The zone is made perceptible in normal observation by the fact that it is colored, e.g. by adding a dye.

Thus, more particularly in accordance with the invention, said zone includes firstly a dye and secondly iridescent pigments that are practically colorless in normal observation and that present an iridescent effect that is visible only in oblique observation.

Preferably, the invention provides a security sheet including an iridescent security mark observable on its surface, which sheet is characterized by the fact that said mark comprises at least two zones, each presenting an iridescent effect, said zones being colored in normal observation with the naked eye, and at least one of the zones including iridescent pigments that are (intrinsically) practically colorless in normal observation and that present an iridescent effect (color change effect) that is visible only in oblique observation.

Generally, the zone(s) and the mark are plane and the zone(s) is/are in the same plane as the mark.

Preferably, said two zones include (intrinsically) iridescent pigments that are practically colorless (imperceptible) in normal observation and that present iridescent effects that are visible only in oblique observation.

In a particular embodiment of the invention, said zones are of hue that is uniform under normal observation and they present iridescent effects that are different in oblique observation. More particularly, each of said zones includes firstly a dye, said dye being such that said zones have the same hue, and secondly iridescent pigments, said pigments presenting iridescent effects that differ from one zone to the other.

In a particular embodiment of the invention, one of the zones may include iridescent pigments presenting (non-iridescent) color in normal observation. Under such circumstances, the dye added to the iridescent compositions may have the same hue as the pigments so as to mask the color of the pigments in normal observation.

In another particular embodiment of the invention, said zones are of different hues in normal observation and they present iridescent effects that are substantially identical in oblique observation. More particularly, each of said zones includes firstly a dye, said dye being such that the hue differs from one zone to the other, and secondly iridescent pigments, said pigments presenting iridescent effects that are identical from one zone to the other, and preferably the iridescent pigments are identical in both zones.

Said dye is preferably of a pastel hue. Quantities are adjusted as a function of the desired effect so that the iridescent effect is not masked. The person skilled in the art may adjust quantities by measuring colorimetric coordinates, such as CIELAB coordinates and Gardner brightnesses, of the iridescent and colored compositions, thus making it possible to produce iridescent zones that are applied on the medium for protection. According to the invention, the quantity of dye lies in the range 0.050 to 0.2% by dry weight relative to the iridescent pigments.

Preferably, the quantity of iridescent pigments deposited on said sheet lies in the range 2 grams per square meter ($g/m^2$) to 8 $g/m^2$.

The iridescent pigments may be selected in particular from pigments based on mica and titanium dioxide. They may be selected from the following ranges: Iriodin® from Merck; Mearlin; Phoenix from Eckart; products from Taïzhu, Longhua, or Hang Zhou Riwa Chemical. They may also be selected from Dynacolor products from Engelhard; Chromaflair/Secureshift from Flex Product.

Preferably, in accordance with the invention said zones are observable simultaneously.

The zones may be one or more continuous strips that are solid or with voids and/or a sequence of repetitive or differing patterns, possibly being connected together and/or disjoint.

In a particular embodiment of the invention, said zones are juxtaposed.

In another particular embodiment of the invention, said zones lie one within the other.

In a particular embodiment of the invention, said zones are partially superposed, thereby forming another colored and iridescent zone.

In a particular embodiment of the invention, said security mark, in particular the at least said zone, comprises a pattern, in negative or positive, that is free from any iridescent effect.

In a particular embodiment of the invention, said security mark, in particular the at least said zone, further includes a compound that is observable under UV radiation.

More particularly, each of said zones includes a fluorescent compound, said compound being different depending on the zone.

In a particular embodiment of the invention, said security mark further includes at least one tactile-effect element. The tactile effect may be smooth or rough, in particular.

Preferably, said tactile example is present in the at least said zone.

In a first embodiment, said tactile-effect element is a polyurethane (PU), in particular selected from PU microspheres and PU in an aqueous dispersion of PU (latex), and in particular they may impart a smooth feel.

In another particular embodiment, said tactile-effect element is constituted by the iridescent pigments of the at least said zone, and in particular they may impart a feel that is a little rough, e.g. by using pigments that are somewhat coarse.

In a particular embodiment of the invention, said tactile-effect element comprises a first tactile effect derived from PU present in one of the zones and a second tactile effect coming from iridescent pigments present in the other zone.

According to the invention, the security sheet is based on cellulose fibers, in particular cotton fibers, and/or synthetic fibers such as polyamide and/or polyester fibers, or it is based on a sheet of plastics material such as a polyolefin film, e.g. made of extruded polyethylene. The weight of said sheet depends on the intended application, and in particular it lies in the range 80 $g/m^2$ to 150 $g/m^2$.

The security mark is applied to the medium of the sheet, e.g. by photogravure or by silkscreen-printing.

According to the invention, the sheet may further include another security element such as a watermark, a security thread, a hologram. In a particular embodiment, said iridescent security mark does not have any other security element placed on its surface, in particular it does not have an optically variable element or device (OVD).

The invention also provides a security document comprising said sheet. According to the invention, the security document is selected from identity documents, in particular an identity card or a passport, payment means, in particular bank notes or checks, tickets for entry to cultural or sports events, transport tickets, playing cards. The document may also be selected from secure packaging, in particular for medicines, electronic components, spare parts, perfumes, and secure labels.

BRIEF DESCRIPTION OF DRAWINGS

The invention can be better understood with the help of the following Examples 1 to 8 of the invention and corresponding accompanying FIGS. 1 to 10.

EXAMPLE 1

Figure 1:
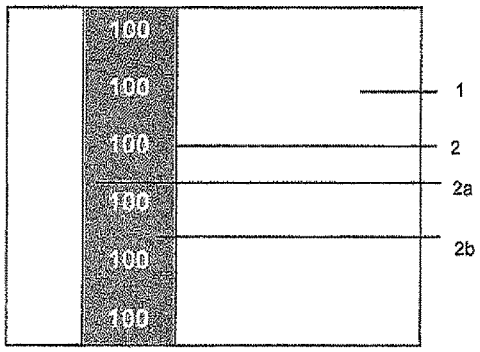
FIGS. 1, 3, 5, 7, and 9 are face views of security sheets of the invention in normal observation.

On a sheet of security paper having a weight of 100 $g/m^2$, a security mark was printed by photogravure, the mark being in the form of a strip, with a void being left having the form "10", by applying an aqueous ink comprising a blue dye (blue Cartarene CBR 500 from the supplier Clariant) and iridescent pigments based on mica/$TiO_2$ (Gold Iriodin® 205 from the supplier Merck) presenting a gold iridescent effect that is visible only in oblique observation. The ink may contain other conventional additives such as a curing agent, an anti-foaming agent, binders (a hydrosoluble binder such as polyvinyl alcohol (PVA) and/or latex type binders such as a polyurethane), or indeed a viscosity regulator.

The ink contained 44.8 grams (g) of iridescent pigments and 0.05 g of blue dye per 100 g of the ink composition by dry weight. The iridescent composition was deposited by photogravure at 12 $g/m^2$, with the iridescent pigment being deposited at 5.4 $g/m^2$; the dye was deposited at 0.11% by dry weight relative to the iridescent pigments.

That produced a mark that appeared to be uniformly blue in normal observation (at an angle of 90 degrees relative to the plane of the region), with the pattern "10" appearing in negative (no ink) and with a gold iridescent effect appearing only in oblique observation.

EXAMPLE 2

On a sheet of security paper 1 having a weight of 100 $g/m^2$, a security mark 2 was photogravure printed so as to produce a first zone 2*a* in the form of a strip while leaving a void in the form of a "1", by applying an aqueous ink A1 comprising a green dye (green Cartarene CVB from the supplier Clariant) and iridescent pigments based on mica/$TiO_2$ (Blue Iriodin® 225 from the supplier Merck) presenting a blue iridescent effect that is visible only in oblique observation, and also producing a second zone 2*b* in the form of a strip juxtaposed with the first strip, while leaving two voids side by side each having the form of a "0" and located beside the "1" of the zone 2*a*, by applying an aqueous ink B1 comprising said green dye and iridescent pigments based on mica/$TiO_2$ (Lilac Iriodin® 219 from the supplier Merck) presenting a violet iridescent effect that is visible only in oblique observation. The iridescent pigments themselves are practically colorless in normal observation. The inks may contain other conventional additives such as a curing agent, an anti-foaming agent, binders (a hydrosoluble binder such as polyvinyl alcohol (PVA) and/or latex type binders such as a polyurethane), or indeed a viscosity regulator. Each of the inks A1 and B1 comprised 44.8 g of iridescent pigments and 0.03 g of green dye per 100 g of ink composition by dry weight. The hue of the inks was adjusted by colorimetric measurements and by Gardner brightness measurements. The iridescent compositions A1 and B1 were deposited on the sheet by photogravure at 12 g/$m^2$ (per composition), the iridescent pigments being deposited at 5.4 g/$m^2$ and the dye at 0.005 g/$m^2$; there was thus about 0.1% by dry weight of dye deposited relative to the iridescent pigments.

The colorimetric data for the mark made up of the two strips is as follows:

| | |
|---|---|
| Gardner brightness at 75 degrees | 28.5 |
| CIE whiteness | 40.8 |
| ISO whiteness | 70.4 |
| Yellow degree | 10.79 |
| L | 91.34 |
| a* | −5.87 |
| b* | 8.06 |

Figure 2:
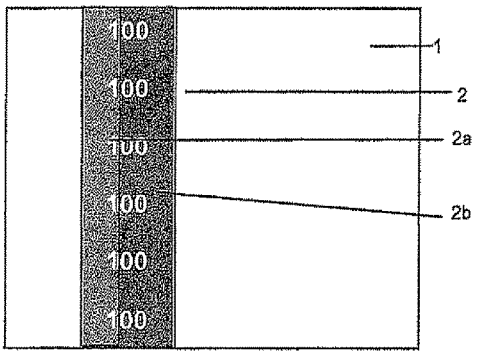
FIGS. 2, 4, 6, 8, and 10 are views of security sheets of the invention in oblique observation.

A mark was thus obtained that was made up of two juxtaposed zones (2*a*, 2*b*), said mark appearing to be uniformly green in normal observation (at an angle of 90 degrees relative to the plane of the region) with the pattern "100" appearing in negative (no ink), as shown in FIG. 1, and with iridescent effects appearing only in oblique observation and differing between the zones as shown in FIG. 2, where the zone 2*a* has a blue effect and the zone 2*b* a violet effect.

EXAMPLE 3

On a sheet of security paper 1, a security mark 2 was silkscreen printed to produce a first zone 2*a* in the form of a strip by applying an aqueous ink A2 comprising a red dye and iridescent pigments based on mica/$TiO_2$ (Iriodin® 235 from the supplier Merck) presenting a green iridescent effect visible only in oblique observation, and also producing a second zone 2*b* contained within the first zone, in the form of a hexagon having two voids presenting the shapes of an "A" and a "W" by applying an aqueous ink B2 comprising said red dye and iridescent pigments based on mica/$TiO_2$ (Iriodin® 205 from the supplier Merck) presenting a gold iridescent effect visible only in oblique observation. The iridescent pigments themselves are practically colorless in normal observation. As in Example 2, the inks A2 and B2 had the same hue, this hue being adjusted for each ink as a function of the other ingredients and in particular the iridescent pigments. The inks may contain other conventional additives such as a curing agent, an anti-foaming agent, binders (a hydrosoluble binder such as polyvinyl alcohol (PVA) and/or latex type binders such as a polyurethane), or indeed a viscosity regulator and glycerin. Each of the inks A2 and B2 comprised 28.4 g of iridescent pigments and 0.03 g of red dye per 100 g of the ink composition by dry weight. The hue of the inks was adjusted by colorimetric measurements and by Gardner brightness measurements. The iridescent compositions A2 and B2 were deposited by silkscreen printing at 12 g/$m^2$ (per composition), with the iridescent pigments being deposited at 3.45 g/$m^2$ and the dye being deposited at 0.0031 g/$m^2$, so there was about 0.091% by dry weight of dye deposited relative to the iridescent pigments.

Figure 3:
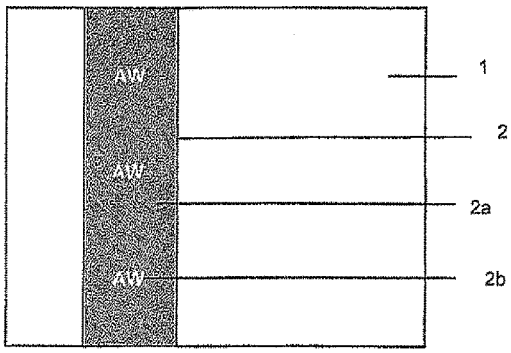
Figure 4:
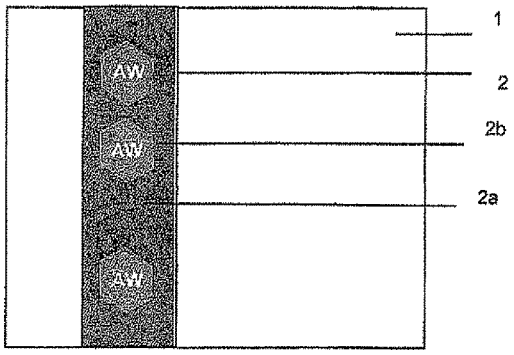

That produced a mark made up of two zones, one within the other (2*a*, 2*b*), said mark appearing to be uniformly red in normal observation, with the pattern "AW" appearing in negative as shown in FIG. 3 and with iridescent effects visible only in oblique observation and differing between the zones as shown in FIG. 4 revealing the hexagon of the zone 2*b* within the strip 2*a*.

EXAMPLE 4

The inks of Example 2 were used again, with a fluorescent compound being added to each of the inks: a red fluorescent compound was added to the ink A1; and a blue fluorescent compound was added to the ink B1. As in Example 2, a security mark was produced on a sheet. Under UV illumination, the mark appeared to be red in the zone 2*a* and blue in the zone 2*b*.

EXAMPLE 5

The same inks were used as in Example 3 with a fluorescent compound being added to each of the inks: a red fluorescent compound was added to the ink A2; and a blue fluorescent compound was added to the ink B2. As in Example 3, a security mark was produced on a sheet. Under UV illumination, the mark appeared red in the zone 2*a* and blue in the zone 2*b*.

EXAMPLE 6

On a sheet of security paper 1, a security mark 2 was photogravure printed, producing a first zone 2*a* in the form of a strip by applying an ink A5 comprising a green dye and iridescent pigments based on mica/$TiO_2$ (Iriodin® 205 from the supplier Merck) presenting a gold iridescent effect, visible only in oblique observation, and also producing a second zone 2*b* juxtaposed with the first, in the form of a hexagon having two voids in the form of an "A" and a "W" by applying an ink B5 comprising a blue dye and the same iridescent pigments as in ink A5. The iridescent pigments themselves are practically colorless in normal observation. The inks A5 and B5 were thus of different hues.

Figure 5:
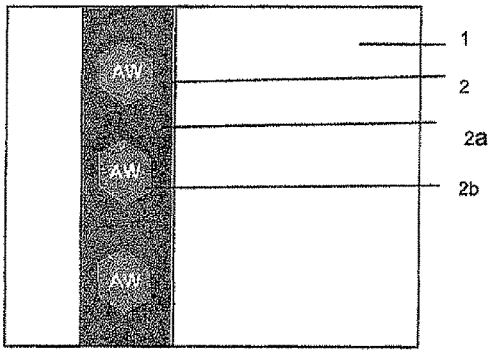
Figure 6:
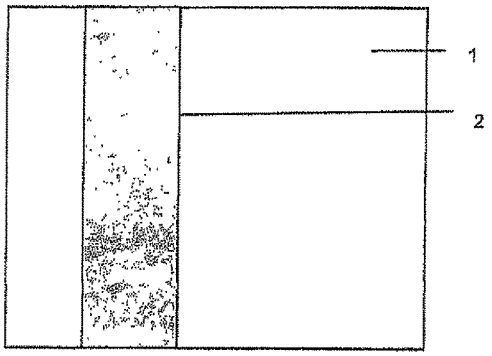

That produced a mark made up of two zones, one within the other, said region appearing in the form of two zones of different hues in normal observation, one zone being green and the other blue in the shape of a hexagon including the pattern "AW" appearing in negative, as shown in FIG. 5, and with iridescent effects visible only in oblique observation and similar in both zones, the hexagon no longer being different, as shown in FIG. 6.

EXAMPLE 7

On a sheet of security paper 1, a security mark 2 in the form of a strip was photogravure printed, by producing a first zone 2*a* in the form of a strip having voids in the form "100" and voids in the form "AW", by applying an ink comprising a green dye (green Catarene from the supplier Clariant) and iridescent pigments based on mica/$TiO_2$ (Lilac Iriodin® 219 from the supplier Merck) presenting a violet effect visible only in oblique observation. A second zone 2*b* was also produced in the form of a pattern "100" by applying an ink comprising the same green dye (green Catarene from the supplier Clariant) and iridescent pigments based on mica/$TiO_2$ (Iriodin® 225 from the supplier Merck) presenting a blue effect visible only in oblique observation, said patterns "100" being applied in register with the voids in the form "100" in the first zone 2*a*, so as to coincide. The iridescent pigments of the zones 2*a* and 2*b* are practically colorless in normal observation.

Figure 7:
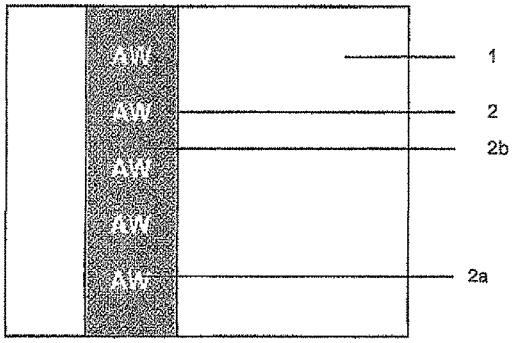
Figure 8:
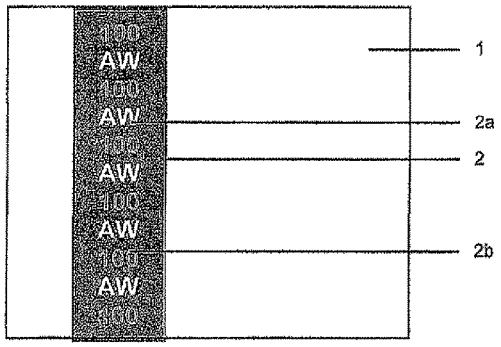

That produced in normal observation, a mark that appeared as a green strip with "100" as voids, as shown in FIG. 7. In oblique observation, a strip was obtained presenting a violet effect, with (ink-free) voids in "AW" form and "100" patterns presenting a blue effect as shown in FIG. 8.

EXAMPLE 8

On a sheet of security paper 1, a security region 2 in the form of a strip was printed by photogravure, producing a first zone 2*a* in the form of a strip including hexagonally-shaped voids, by applying an ink comprising a green dye (green Catarene by the supplier Clariant) and iridescent pigments based on mica/$TiO_2$ (Lilac Iriodin® 219 from the supplier Merck) presenting a violet effect visible only in oblique observation. A second zone 2*b* was also made by applying within each hexagonally-shaped void an "AW" pattern using an ink comprising a green dye (green Catarene from the supplier Clariant) and iridescent pigments based on mica/$TiO_2$ (Iriodin® 225 from the supplier Merck) presenting a blue effect visible only in oblique observation. The iridescent pigments of the zones 2*a* and 2*b* are practically colorless in normal observation.

Figure 9:
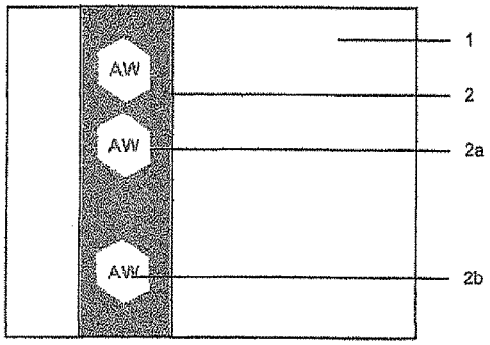
Figure 10:
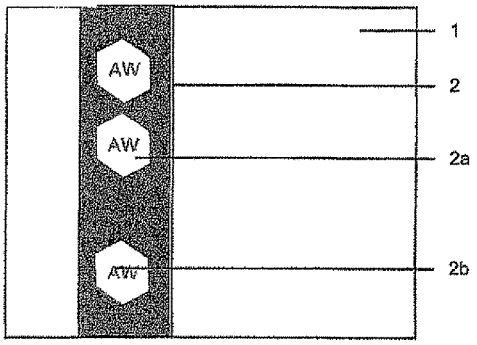

That produced, in normal observation, a mark that appeared as a green strip with (ink-free) voids of hexagonal shape, each hexagon containing an "AW" pattern having the same color as the strip, as shown in FIG. 9. In oblique observation, a strip was obtained presenting a violet effect with (ink-free) voids of hexagonal shape and "AW" patterns presenting a blue effect, as shown in FIG. 10.

The invention claimed is:

1. A security sheet comprising an iridescent security mark observable on a surface of the sheet, said mark comprising at least two zones, each presenting an iridescent effect, said zones having coloration observable by reflected light in normal observation with an unaided eye, said coloration making said zones perceptible in normal observation, and at least one of the zones including iridescent pigments that are intrinsically colorless in normal observation and that present an iridescent effect that is visible only in oblique observation, each of said zones including firstly a dye, said dye being such that said zones have the same hue, and secondly iridescent pigments, said pigments presenting in oblique observation iridescent effects that differ from one of the zones to another of the zones.

2. A security sheet according to claim 1, said two zones presenting iridescent effects that are visible only in oblique observation.

3. A security sheet according to claim 2, said two zones including iridescent pigments that are practically colorless in normal observation and that present iridescent effects that are visible only in oblique observation.

4. A security sheet according to claim 1, said zones being observable simultaneously.

5. A security sheet according to claim 1, said zones being juxtaposed.

6. A security sheet according to claim 1, wherein one of said zones is within another of said zones.

7. A security sheet according to claim 1, said zones being partially superposed.

8. A security sheet according to claim 1, each of said zones including a fluorescent compound, said compound differing from one zone to the other.

9. A security sheet according to claim 1, said at least one mark further including at least one tactile-effect element comprising a polyurethane first tactile effect present in one of the zones and an iridescent-pigment second tactile effect present in another of the zones.

10. A security sheet comprising an iridescent security mark observable on a surface of the sheet, said mark comprising at least two zones, each presenting an iridescent effect, said zones having coloration observable by reflected light in normal observation with an unaided eye, said coloration making said zones perceptible in normal observation, and at least one of the zones including iridescent pigments that are intrinsically colorless in normal observation and that present an iridescent effect that is visible only in oblique observation, said at least one mark further including at least one tactile-effect element comprising a polyurethane first tactile effect present in one of the zones and an iridescent-pigment second tactile effect present in another of the zones.

* * * * *